US006053579A

United States Patent [19]

Nelson et al.

[11] Patent Number: 6,053,579

[45] **Date of Patent: *Apr. 25, 2000**

[54] HEIGHT-ADJUSTABLE CHAIR ARM ASSEMBLY HAVING CAM-TYPE ADJUSTING MECHANISM

[75] Inventors: Patrick C. Nelson, Holland; Larry A. Wilkerson, Comstock Park, both of Mich.

[73] Assignee: Haworth, Inc., Holland, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/774,353

[22] Filed: Dec. 27, 1996

[51] Int. Cl.[7] ..... A47C 7/54

[52] U.S. Cl. ..... 297/411.36; 297/411.2

[58] Field of Search ..... 297/411.2, 411.35, 297/411.36, 411.26, 411.27, 440.24; 248/118.3

[56] References Cited

U.S. PATENT DOCUMENTS

| | | | |
|---|---|---|---|
| 232,790 | 9/1880 | Wernert . | |
| 441,964 | 12/1890 | Neppert . | |
| 493,111 | 3/1893 | Parsons . | |
| 504,683 | 9/1893 | Peartree . | |
| 2,569,834 | 10/1951 | Smith . | |
| 4,489,981 | 12/1984 | Goletski | 297/411.36 |
| 4,934,750 | 6/1990 | Eichler et al. | 296/37.8 |
| 5,050,933 | 9/1991 | Tornero et al. . | |
| 5,242,138 | 9/1993 | Kornberg | 297/411.36 X |
| 5,265,938 | 11/1993 | Melhuish et al. . | |
| 5,318,347 | 6/1994 | Tseng . | |
| 5,324,096 | 6/1994 | Schultz . | |
| 5,346,284 | 9/1994 | Dauphin . | |
| 5,368,365 | 11/1994 | Feldberg . | |
| 5,382,079 | 1/1995 | Wilson et al. . | |
| 5,388,892 | 2/1995 | Tornero . | |
| 5,393,124 | 2/1995 | Neil . | |
| 5,393,125 | 2/1995 | Watson et al. . | |
| 5,435,626 | 7/1995 | Lai . | |
| 5,439,267 | 8/1995 | Peterson et al. | 297/411.36 |
| 5,620,233 | 4/1997 | Corwin | 297/411.36 |
| 5,647,638 | 7/1997 | Ritt et al. | 297/411 |
| 5,829,839 | 11/1998 | Wilkerson et al. | 297/411.36 |
| 5,853,223 | 12/1998 | Ritt et al. | 297/411.36 |

OTHER PUBLICATIONS

U.S. Ser. No. 08,/486,613, filed Jul. 15, 1997, now attached U.S. Pat. No. 5,647,638 (Client Ref: Haworth Case 165).

Copending U.S. Ser. No. 08/857 032, filed May 15, 1997 (Client Ref: Haworth Case 165A) and copies of the drawings therefrom.

Copending U.S. Ser. No. 08/731 712, filed Oct. 17, 1996 (Client Ref: Haworth Case 196) and copies of the drawings therefrom.

*Primary Examiner*—Milton Nelson, Jr.
*Attorney, Agent, or Firm*—Flynn, Thiel, Boutell & Tanis, P.C.

[57] ABSTRACT

A chair having height-adjustable arm assemblies mounted adjacent opposite sides of a seat. Each arm assembly includes an elongate armrest connected to an upper end of an arm upright. The arm upright includes a vertical support segment which has a guide bore therein. The armrest includes a vertically elongate slide tube and a horizontally elongate arm element connected to an upper end of the slide tube. A lower end of the slide tube is movably mounted within the guide bore. A latch arrangement permits the slide tube to be positioned relative to the support segment at any one of a plurality of height positions. The latch arrangement includes a cartridge assembly received within a window defined in a vertical wall of the slide tube. The cartridge assembly includes a latch member movably supported within a box-like housing and movable to engage one of a series of latching notches. An activating mechanism functions to move the latch member between latching and release positions. The activating mechanism includes an activating lever pivotally supported on the arm element, and an activating rod with an upper end which cooperates with the activating lever and a lower end that engages a roller which engages a cam surface of the latch member.

18 Claims, 5 Drawing Sheets

HEIGHT-ADJUSTABLE CHAIR ARM ASSEMBLY HAVING CAM-TYPE ADJUSTING MECHANISM

FIELD OF THE INVENTION

The invention relates to chairs with adjustable arms and, more particularly, to an armrest which can be conveniently vertically adjusted with respect to the chair seat.

BACKGROUND OF THE INVENTION

Chairs designed for use particularly in office environments and the like are being increasingly provided with adjustment features so as to improve the ergonomics of the chair, particularly in those situations where the chair is used for long periods of time, such as when an occupant is working at a computer terminal, to provide improved comfort and healthful support of the occupant's body. One of the areas which has been addressed to improve such comfort relates to the chair arms, and some known chairs have provided arms having position adjustability, particularly with respect to the ability to vary the armrest height relative to the seat. The known chairs which possess height-adjustable chair arms typically employ vertically telescopic supports and a cooperating releasable latch arrangement for permitting height adjustment. Most known arrangements, however, have disadvantages, either from a manufacturing or structural viewpoint, or from an operational viewpoint. For example, many of the structures are undesirably complex, and/or the overall support arrangement and cooperating latch mechanism is such as to make release of the latch and adjustment of arm height difficult or inconvenient, particularly to an occupant seated in the chair.

Examples of known height-adjustable chair arms are shown in the following U.S. Pat. Nos. 5,439,267, 5,435,626, 5,393,125, 5,393,124, 5,388,892, 5,382,079, 5,368,365, 5,346,284, 5,324,096, 5,318,347 and 5,265,938.

Accordingly, it is an object of this invention to provide a chair having a height-adjustable arm assembly associated therewith, which arm assembly significantly improves upon and overcomes many of the disadvantages as briefly summarized above.

More specifically, the improved height-adjustable chair arm assembly of this invention provides an improved latching mechanism which extends through the arm rest and into the arm upright so as to permit easy and efficient unlatching and height adjustment if desired, with the occupant in a seated position being able to easily release and maintain the latching mechanism in an unlatched position while at the same time permitting the occupant to easily raise or lower the arm while seated, and then permit the latch to re-engage.

Briefly, the present invention comprises a chair having height-adjustable arm assemblies respectively mounted adjacent opposite sides of a seat. Each arm assembly includes a horizontally elongate armrest which is connected to an upper end of an arm upright. The arm upright includes a vertically oriented support segment which has a guide bore defined therein. The armrest includes a vertically elongate slide tube and a horizontally elongate arm element. The arm element is connected to an upper end of the slide tube. A lower end of the slide tube is movably mounted within the guide bore. A latch arrangement functions to permit the slide tube to be positioned relative to the support segment at any one of a plurality of height positions. The latch arrangement includes a cartridge assembly slidably received within a window defined in a vertical wall of the slide tube. The cartridge assembly includes a latch member which is movably supported within a box-like housing and is movable so as to engage one of a series of latching notches. A latch-activating mechanism functions to move the latch member between a latching position and a release position. The latch-activating mechanism includes an activating lever and an activating rod. The activating lever is pivotally supported on the arm element and the activating rod has an upper end which cooperates with the activating lever and a lower end that engages a roller which cooperates with a cam surface of the latch member.

Other objects and purposes of the invention will be apparent to persons familiar with structures of this general type upon reading the following specification and inspecting the accompanying drawings.

Figure 1:
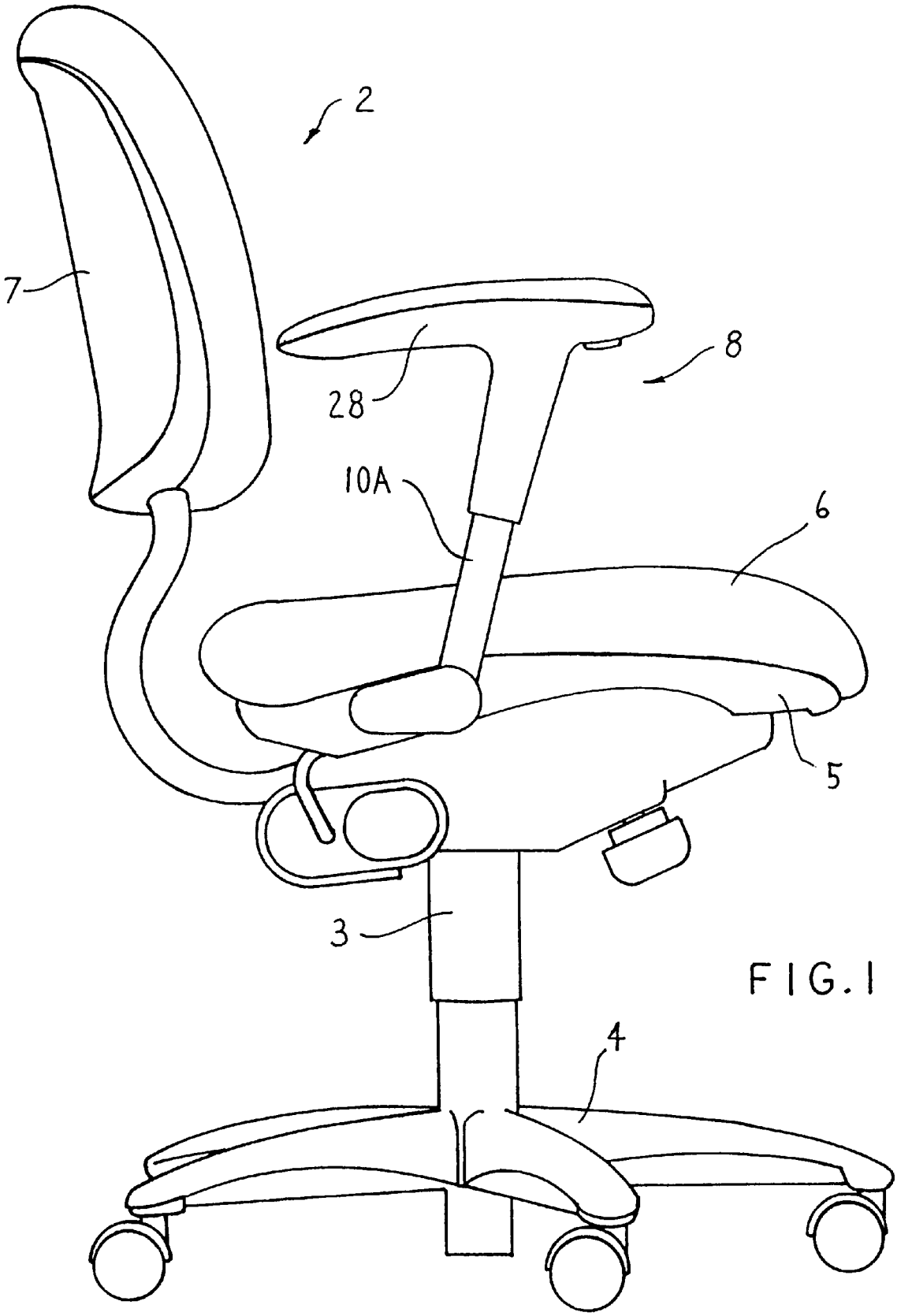
FIG. 1 is a side elevational view of a chair having the improved height-adjustable chair arm assembly of this invention mounted thereon, this view showing the right-side charm arm assembly.
Figure 2:
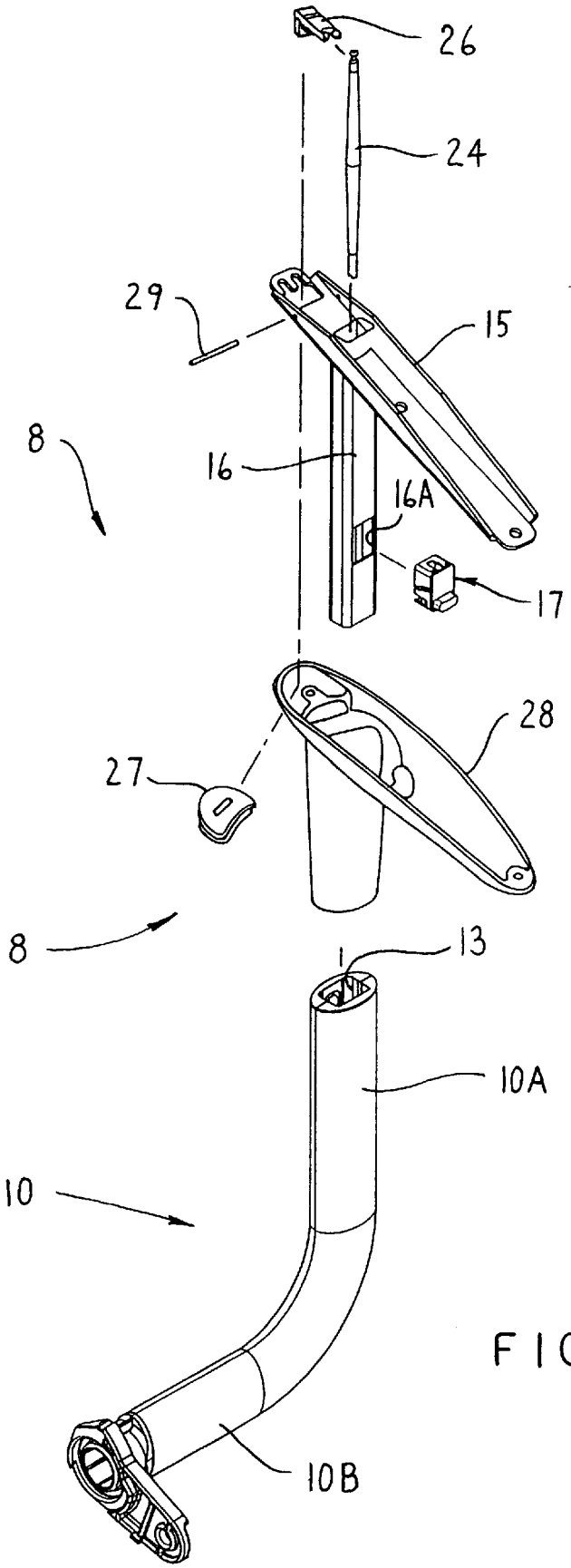
FIG. 2 is an exploded perspective view of a right-side height-adjustable chair arm assembly according to the present invention, the chair arm assembly being shown removed from the chair for clarity of description, and further a portion of the armrest being shown removed from the chair arm assembly for clarity of description.

Certain terminology will be used in the following description for convenience in reference only, and will not be limiting. For example, the words "upwardly", "downwardly", "rightwardly" and "leftwardly" will refer to directions in the drawings to which reference is made. It will be understood that the words "upwardly" and "downwardly" will also refer to the directions of height adjustment of the armrest relative to the chair seat, these being the actual physical directions experienced by the chair occupant during height adjustment. The words "inwardly" and "outwardly" will respectively refer to directions toward and away from the center of the chair, the center of the arm assembly, or designated parts thereof. Said terminology will include the words specifically mentioned, derivatives thereof, and words of similar import.

DETAILED DESCRIPTION

FIG. 1 diagrammatically illustrates a chair 2, often referred to as an office-type chair. This chair employs a center pedestal 3 which projects upwardly from a base 4. A suitable seat assembly is mounted on an upper end of the center pedestal 3. The seat assembly includes a chair seat 6 and a chair control or seat frame 5. The chair control 5 supports the chair seat 6 and is mounted thereto. A chair back 7 projects upwardly from a location above the rear edge of the chair seat 6.

The chair 2 is provided with a pair of height-adjustable arm assemblies 8 mounted thereon, namely right and left assemblies which are respectively disposed adjacent the right and left sides of the seat 6 so as to project upwardly therefrom to hence permit the chair occupant to be seated therebetween. The right and left chair arm assemblies 8 are substantially identical except for being mirror images of one another, and only the right side assembly is visible in FIG. 1.

Figure 3:
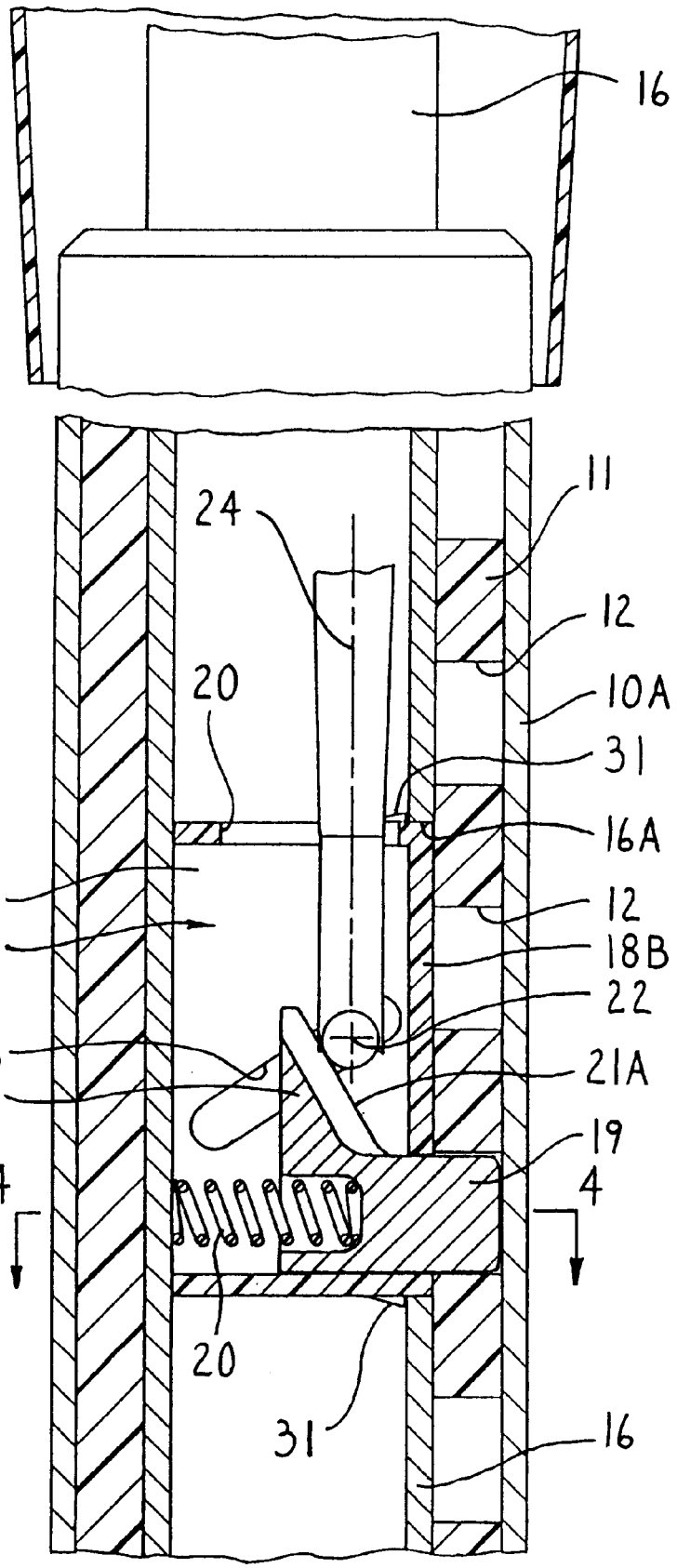
FIG. 3 is a fragmentary sectional view of the chair arm assembly of FIG. 1, with the latch being shown engaged within one of the notches of the sleeve of the chair arm assembly so as to maintain the armrest at a desired height.
Figure 4:
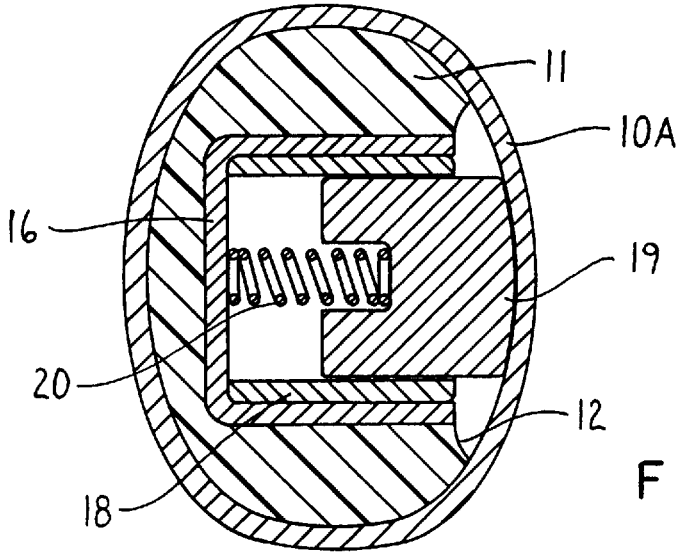
FIG. 4 is a sectional view taken generally along line 4—4 in FIG. 3.
Figure 6:
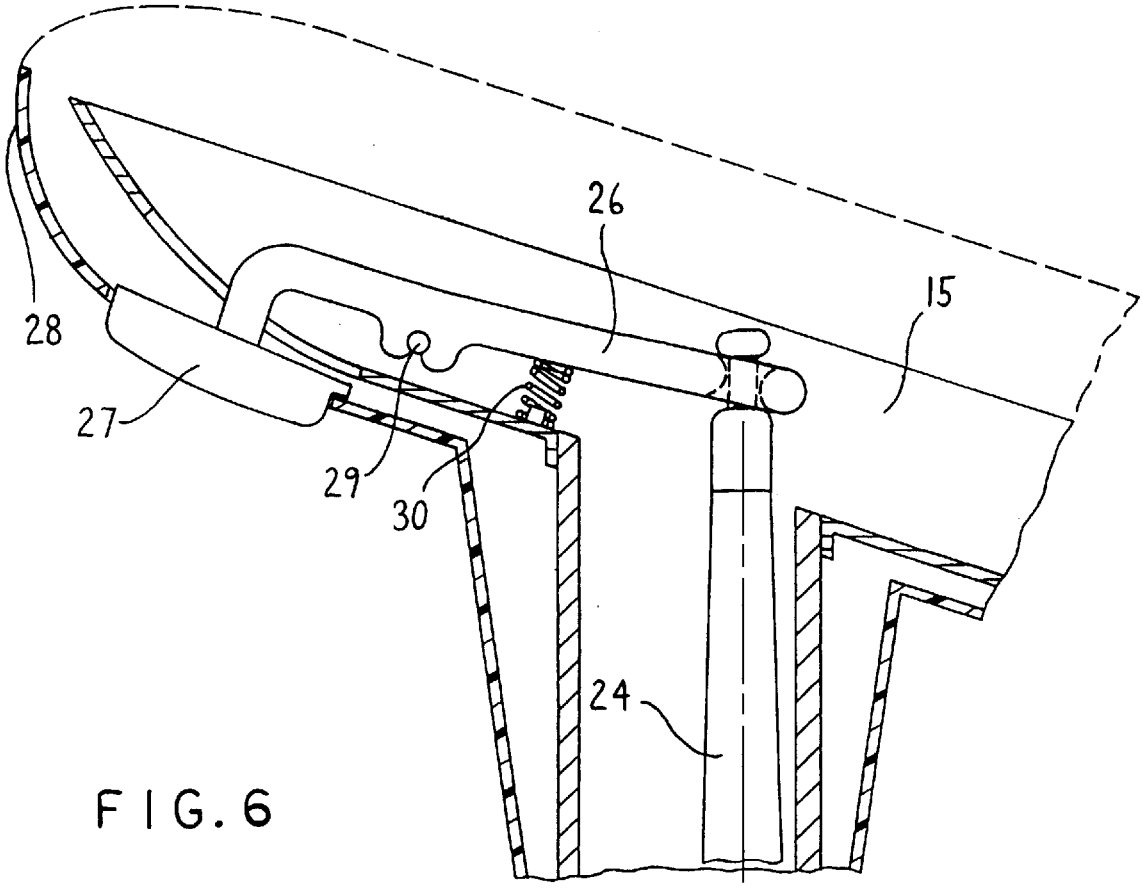
FIG. 6 is a fragmentary sectional view of an upper portion of the chair arm assembly of FIG. 1 which shows the cooperation between the actuator rod and the actuator lever.

Referring now to FIGS. 2–6, the right side height-adjustable arm assembly 8 includes an arm upright 10 which is fixed to and projects upwardly from adjacent the seat 6. The arm upright 10 in the illustrated embodiment is generally L-shaped and includes a base leg 10B which is fixed to the seat frame 5, and also includes a vertically elongate and upwardly cantilevered support leg or segment 10A. The support segment 10A has a plastic sleeve 11 fixed vertically therein. The sleeve 11 defines a guide bore 13 which extends through the sleeve. The sleeve 11 includes a plurality of uniformly vertically spaced notches 12 defined therein as shown in FIG. 3.

The arm assembly 8 further includes an arm element having a slide tube 16 fixed thereto and projecting downwardly therefrom. The tube 16, which in the illustrated embodiment is rectangular in cross section, is slidably but nonrotatably supported within the guide bore 13 of the sleeve 11. The arm assembly 8 additionally includes a compact cartridge assembly 17 which is secured interiorly of the tube 16 adjacent the lower end thereof. This cartridge assembly has a box-like housing 18, the front wall 18B of which fits within a window 16A formed in the side of the tube 16. The top and bottom walls of housing 18 have tabs 31 which snap into position behind the tube wall to fixedly position the cartridge assembly 17 within the tube 16 while enabling the cartridge assembly to be inserted through the window 16A.

Figure 5:
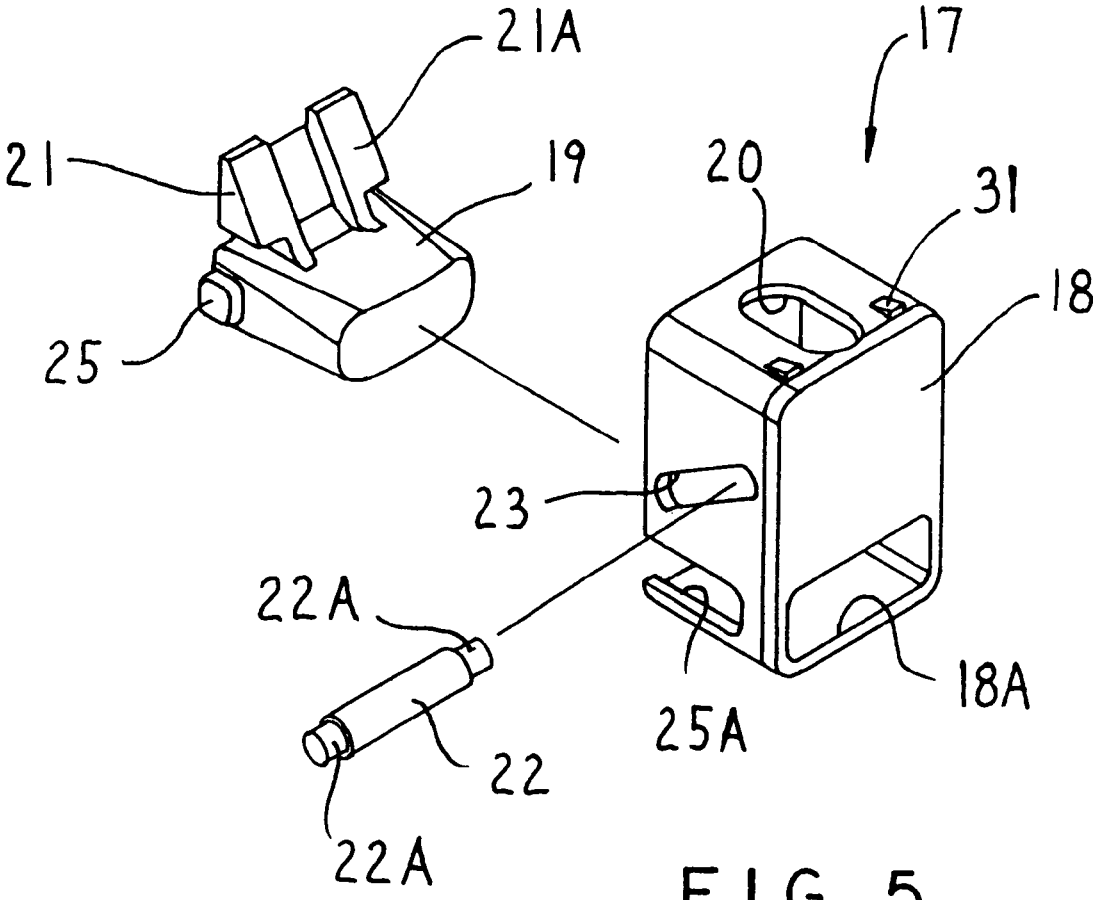
FIG. 5 is an exploded perspective view of the compact cartridge assembly of FIG. 3.

The cartridge housing 18 has a latch 19 slidably supported therein adjacent the bottom wall thereof and urged by a spring 20 so that the nose of the latch 19 projects through an opening 18A formed in the front wall of the housing 18 for engagement with one of the notches 12 formed in sleeve 11. The latch 19 includes a pair of guide posts 25 (FIG. 5) which project outwardly from opposite sides thereof. The guide posts 25 are slidably received within a pair of elongate guide slots 25A respectively defined with the opposed side walls of housing 18. Note that only one guide post 25 and one guide slot 25A are shown in FIG. 5. The latch 19 has an upwardly tapered cam 21 defining thereon a generally flat cam surface 21A engaged by an elongated roller 22. The cam surface 21A is downwardly sloped relative to the vertical so as to project toward the opening 18A. The reduced diameter end parts 22A of roller 22 are confined within a pair of cam slots 23 formed in the opposed side walls of housing 18, which slots 23 are reversely inclined relative to the cam surface 21A. Note that only one cam slot 23 is shown in FIG. 5. Roller 22 is resiliently retained within a bifurcated lower end of a vertically elongate actuator rod 24 which extends downwardly through an opening 20 defined in a horizontal top wall of the cartridge housing 18. The actuator rod 24 projects upwardly through the tube 16 into the arm element 15 and has its upper end coupled to an actuator lever 26. The actuator lever 26 is pivotally supported on the arm element 15 by a transverse horizontal pivot 29. The actuator lever 26 has a finger-engaging part or pad 27 disposed under a front part of an armrest 28 of the arm assembly 8 for engagement by the chair occupant.

When the occupant presses pad 27 upwardly, actuator lever 26 is caused to pivot about pivot pin 29 against the bias of spring 30. In turn, actuator rod 24 is depressed by actuator lever 26 so as to cause the actuator rod to be forced downwardly to push the roller 22 against the inclined cam 21 to thereby withdraw the latch 19 from the notch 12. With the latch 19 withdrawn from the notch 12, the occupant can then vertically raise and lower the armrest 28. When reaching a desired position, the occupant releases the pad 27 and then any slight vertical movement will cause the spring 20 to urge the latch 19 into the closest adjacent notch 12 to lock the armrest 28 at a desired height.

Although a particular preferred embodiment of the invention has been disclosed in detail for illustrative purposes, it will be recognized that variation or modifications of the disclosed apparatus, including the rearrangement of parts, lie within the scope of the present invention.

What is claimed is:

1. A height-adjustable arm assembly for a chair, comprising:

an arm upright including an elongate support segment, said support segment defining therein a guide bore which is open at one end thereof, said support segment having a series of latching notches formed therein;

an armrest having a slide tube and an arm element, said slide tube having a first end which is supported within said guide bore and a second end which is attached to said arm element, said slide tube having a window defined in a vertical wall thereof;

a latch arrangement for permitting said slide tube to be positioned relative to said support segment at any one of a plurality of height positions, said latch arrangement including a latch member being movable between a latching position and a release position, said latch member being engaged with one of the series of latching notches when in said latching position, said latch arrangement further including a cartridge assembly which includes a box-like housing which is received within said window of said slide tube, said latch member being slidably positioned within said box-like housing; and a latch-activating mechanism for moving said latch member between said latching position and said release position, said latch-activating mechanism including an activating lever supported on said arm element, and an activating rod extending into said support segment, said activating rod having an upper end cooperating with said activating lever and a lower end engaging a roller which cooperates with a cam surface of said latch member.

2. In a chair having a seat assembly, a back projecting upwardly from a location adjacent a rear edge of the seat assembly, and a pair of height-adjustable arm assemblies mounted on and disposed adjacent opposite sides of said seat assembly and projecting upwardly in cantilevered relation therefrom, the improvement wherein each arm assembly comprises:

an arm upright fixed to said seat assembly and including a vertically elongate support segment disposed on one side of said seat assembly, said support segment defining therein a vertically elongate guide bore which is open at an upper end thereof;

an armrest having a vertically elongate slide tube lengthwise movably supported within said guide bore and projecting upwardly therefrom and terminating at an upper end part which is disposed at an elevation spaced upwardly above said seat assembly, said armrest further having a horizontally elongate arm element mounted on the upper end part of said slide tube and projecting horizontally therefrom;

a releasable latch arrangement coacting between said support segment and said slide tube for permitting said slide tube to be stationarily fixedly positioned relative to said support segment at any one of a plurality of selectable height positions, said latch arrangement including a latch member movably supported and carried in said slide tube and being movable between a release position and a latching position, said latch member when in said latching position being engaged with one of a series of latching notches which are formed in lengthwise-spaced relation along said support segment; and a latch-activating mechanism extending from said armrest into said support segment for displacing said latch member between said release position and said latching position, said latch-activating mechanism including an activating arm extending lengthwise of and movably supported on said arm element and terminating in a manually-engagable button part disposed at an underside of said arm element adjacent an end portion thereof, and an activating rod extending interiorly and lengthwise of said support segment and having an upper end cooperating with said activating arm and a lower end engaging a roller which cooperates with a cam surface of said latch member, said slide tube having a window defined in a first vertical wall thereof, and said latch arrangement further including a cartridge assembly which includes a housing which is received within said window of said slide tube, said latch member being slidably positioned within said housing.

3. A chair according to claim 2, wherein said housing has a box-like shape, and further said housing has a pair of elongate cam slots respectively defined in a pair of vertical side walls thereof, and said roller is movably mounted on and between said pair of cam slots.

4. A chair according to claim 3, wherein said latch member is engaged with one of the series of latching notches when said roller is located adjacent a first end of said pair of cam slots, and said latch member is spaced apart from all of the series of latching notches when said roller is located adjacent a second end of said pair of cam slots.

5. A chair according to claim 3, wherein said housing further includes a horizontal top wall having an opening defined therein through which said activating rod extends.

6. A chair according to claim 3, wherein said housing has an aperture defined in a vertical end wall thereof, and said latch member includes a nose portion which is slidable through said aperture so as to be received into one of the series of latching notches when said latch member is positioned in the latching position.

7. A chair according to claim 6, wherein said housing further has a pair of elongate guide slots respectively defined in said pair of vertical side walls, and said latch member further includes a pair of guide posts projecting outwardly therefrom which are slidably received within said pair of elongate guide slots.

8. A chair according to claim 6, wherein said cartridge assembly further includes a spring which is positioned between a second vertical wall of said slide tube and said latch member so as to urge said latch member toward the series of latching notches.

9. A height-adjustable arm assembly for a chair, comprising:

an arm upright including a vertically elongate support segment, said support segment defining therein a vertically elongate guide bore which is open at an upper end thereof;

an armrest having a vertically elongate slide tube lengthwise movably supported within said guide bore and projecting upwardly therefrom and terminating at an upper end part, said armrest further having a horizontally elongate arm element mounted on the upper end part of said slide tube and projecting horizontally therefrom;

a releasable latch arrangement coacting between said support segment and said slide tube for permitting said slide tube to be stationarily fixedly positioned relative to said support segment at any one of a plurality of selectable height positions, said latch arrangement including a cartridge assembly slidably received within a window defined in a first vertical wall of said slide tube, said cartridge assembly including a latch member being movable between a latching position and a release position, said latch member when in said latching position being engaged with one of a series of latching notches which are formed in lengthwise-spaced relation along said support segment; and a latch-activating mechanism for displacing said latch member between said latching position and said release position, said latch-activating mechanism including a vertically-movable activating rod extending interiorly and lengthwise of said support segment and having one end cooperating with an activating part and an other end cooperating with said latch member.

10. An arm assembly according to claim 9, wherein said activating part extends lengthwise of and is movably supported on said arm element and connects to an upper end of said activating rod.

11. An arm assembly according to claim 9, wherein said cartridge assembly further includes a roller, said latch member has a cam fixed thereto, and a lower end of said activating rod engages said roller which contacts said cam to move said latch member from said latching position to said release position.

12. An arm assembly according to claim 11, wherein said cartridge assembly further includes a housing which is secured within said slide tube and is received within said window thereof, said latch member being slidably positioned within said housing.

13. An arm assembly according to claim 12, wherein said housing has a box-like shape, and said housing has a pair of elongate cam slots respectively defined in a pair of vertical side walls thereof, and said roller is movably mounted on and between said pair of cam slots.

14. An arm assembly according to claim 13, wherein said housing further includes a horizontal top wall having an opening defined therein through which said activating rod extends.

15. An arm assembly according to claim 13, wherein said latch member is engaged with one of the series of latching notches when said roller is located adjacent a first end of said pair of cam slots, and said latch member is spaced apart from all of the series of latching notches when said roller is located adjacent a second end of said pair of cam slots.

16. An arm assembly according to claim 15, wherein said housing has an aperture defined in a vertical end wall thereof, and said latch member includes a nose portion which is slidable through said aperture so as to be received into one of the series of latching notches when said latch member is positioned in the latching position.

17. An arm assembly according to claim 16, wherein said cartridge assembly further includes a spring which is positioned between a second vertical wall of said slide tube and said latch member so as to urge said latch member toward the series of latching notches.

18. An arm assembly according to claim 16, wherein said housing has a pair of elongate guide slots respectively defined in said pair of vertical side walls, and said latch member further includes a pair of guide posts projecting outwardly therefrom which are slidably received within said pair of elongate guide slots.

* * * * *

UNITED STATES PATENT AND TRADEMARK OFFICE
CERTIFICATE OF CORRECTION

PATENT NO : 6 053 579
DATED : April 25, 2000
INVENTOR(S) : Patrick C. Nelson, et al.

It is certified that error appears in the above-identified patent and that said Letters Patent are hereby corrected as shown below:

Column 6, line 57; change "Claim 15" to ---Claim 13---.

Column 7, line 2; change "housing has" to ---housing further has---.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*